US008181810B2

(12) United States Patent
Jones

(10) Patent No.: US 8,181,810 B2
(45) Date of Patent: May 22, 2012

(54) DRINKING CUP HAVING STORAGE COMPARTMENT AND LEVER ACTUATED SEAL FOR DRINKING AREA

(75) Inventor: Charles Jones, Rockford, IL (US)

(73) Assignee: J.L. Clark, Inc., Rockford, IL (US)

( * ) Notice: Subject to any disclaimer, the term of this patent is extended or adjusted under 35 U.S.C. 154(b) by 95 days.

(21) Appl. No.: 12/751,754

(22) Filed: Mar. 31, 2010

(65) Prior Publication Data

US 2010/0243653 A1 Sep. 30, 2010

Related U.S. Application Data

(60) Provisional application No. 61/165,352, filed on Mar. 31, 2009.

(51) Int. Cl.
*B65D 51/18* (2006.01)
*A47G 19/22* (2006.01)

(52) U.S. Cl. ..... 220/254.7; 220/254.3; 220/254.5; 220/713

(58) Field of Classification Search ..... 220/254.7, 220/254.5, 254.3, 713
See application file for complete search history.

(56) References Cited

U.S. PATENT DOCUMENTS

| | | | | |
|---|---|---|---|---|
| 5,148,936 | A * | 9/1992 | DeGrow | 220/254.3 |
| 5,415,312 | A * | 5/1995 | Mueller | 220/254.3 |
| 5,456,380 | A * | 10/1995 | Ito et al. | 220/713 |
| 6,325,236 | B1 * | 12/2001 | Wong | 220/713 |
| 6,783,019 | B2 * | 8/2004 | Zettle et al. | 220/254.3 |
| 2005/0127076 | A1 * | 6/2005 | Law et al. | 220/254.1 |
| 2007/0039960 | A1 * | 2/2007 | Pawlik | 220/254.7 |
| 2007/0068891 | A1 * | 3/2007 | Rathbone et al. | 215/235 |
| 2007/0095845 | A1 * | 5/2007 | Auer | 220/713 |
| 2007/0194886 | A1 * | 8/2007 | Bang et al. | 340/10.1 |
| 2008/0078763 | A1 * | 4/2008 | Auer | 220/254.3 |
| 2009/0194535 | A1 * | 8/2009 | Reed et al. | 220/254.3 |

* cited by examiner

*Primary Examiner* — Mickey Yu
*Assistant Examiner* — Niki Eloshway
(74) *Attorney, Agent, or Firm* — Reinhart Boerner Van Deuren P.C.

(57) ABSTRACT

A container and a lid for a container or container is provided. The container includes a lid and container body to which the lid is attached. The container may further include a storage compartment attached to the end of the container body. The lid includes a lid body defining a drinking aperture providing access to a central cavity of the container. The lid includes a snap closure pivoting relative to the lid body between an open position permitting fluid to pass through the drinking aperture, a first closed position with a portion of the snap closure is only biased against, but not engaged with, the lid body to prevent fluid to pass through the drinking aperture and a second closed position wherein the snap closure is engaged with the lid body.

16 Claims, 8 Drawing Sheets

DRINKING CUP HAVING STORAGE COMPARTMENT AND LEVER ACTUATED SEAL FOR DRINKING AREA

CROSS-REFERENCE TO RELATED PATENT APPLICATIONS

This patent application claims the benefit of U.S. Provisional Patent Application No. 61/165,352, filed Mar. 31, 2009, the entire teachings and disclosure of which are incorporated herein by reference thereto.

FIELD OF THE INVENTION

This invention generally relates to liquid containers and more particularly containers for holding drinks and more particularly to containers for holding drinks that include lids with re-sealable openings.

BACKGROUND OF THE INVENTION

Due to the high pace of society, many people drink liquids while on the move, such as in a car or while walking down the street. However, due to the movement which can generate bouncing and splashing of the liquid within the container holding the drink, many of these containers, such as coffee mugs and the like, have lids to prevent the liquids from spilling. However, the inclusion of the lid did not completely prevent leaks and spills. More particularly, spills continued to occur with the inclusion of the lid through vents in the lid that facilitated drinking as well as through the drinking aperture itself.

As a result, mugs began to include closures or caps that sealed off the drinking aperture. However, many of the closures or caps were difficult to operate such that the user would usually either leave the closure or cap in an closed position or an open position and either be prevented from drinking or defeating the purpose of the cap or closure altogether.

The present invention relates to improvements in the drinking container art and particularly to drinking containers including lids that have movable closures for sealing off a drinking aperture through the lid.

BRIEF SUMMARY OF THE INVENTION

The present invention provides numerous features and benefits that may be used and/or have utility individual or in combination. The present invention provides a new and improved lid for a container and more particularly a new and improved lid for a container that provides multiple levels of sealing between a snap closure and the lid body to prevent leakage through a drinking aperture of the lid body.

In a first embodiment, a new and improved container incorporating a lid according to the invention is provided. The container includes a container body and a lid attached to the container body. The container body has an annular sidewall extending from a closed bottom. The annular sidewall and closed bottom define a cavity for storing a liquid. The annular sidewall has an open end opposite the closed bottom. The lid releasably attaches to the open end of the container body. The lid includes a lid body extending across the open end of the container body and substantially closing the open end. The lid body includes a drinking aperture passing therethrough permitting access into the cavity through the lid body. The lid also includes a snap closure attached to the lid body that pivots relative thereto, The snap closure includes a drinking aperture plug aligned with the drinking aperture. The snap closure pivots relative to the lid body between an open position with the drinking aperture plug spaced away from the lid body to permit fluid flow through the drinking aperture, a first closed position wherein the drinking aperture plug is axially biased against an outer surface of the lid body and sealing the drinking aperture, and a second closed position wherein the drinking aperture plug is engaged within the drinking aperture.

In a more preferred implementation, the snap closure further includes a lever tab extending substantially perpendicular to the open end of the container body and a connection leg portion and a lifting leg portion extending substantially perpendicular to the lever tab. The connection leg portion operably attaches to lid body and the lifting leg operably substantially rigidly mechanically connects the lever tab to the drinking aperture plug. The lever tab is radially spaced outward from the annular sidewall such that biasing of the lever tab towards the annular sidewall is translated into axial biasing of the drinking aperture plug away from the lid body to open the drinking aperture.

In an even more preferred embodiment, the snap closure includes a hinge and pivot arrangement interposed between the lever tab and the connection leg and lifting portions. The hinge and pivot arrangement includes at least one cam surface resting against a fulcrum portion of the lid body. Typically, the fulcrum portion is a rim portion of the periphery of the lid body. The hinge and pivot arrangement pivot about the fulcrum portion to bias the drinking aperture plug away from the drinking aperture when the lever tab is biased towards the annular sidewall.

In one embodiment, the snap closure includes a first and second lifting leg portions. The connection leg portion is interposed between and laterally spaced from the first and second lifting leg portions.

In a more preferred embodiment, the hinge and pivot arrangement my include a first chamfer connecting the first lifting leg portion to the lever tab, a second chamfer connecting the second lifting leg portion to the lever tab, and a concave round connecting the connection leg portion to the lever tab. The first and second chamfers straddle the concave round. The first and second chamfers and concave round act to provide a bend point for the first and second lifting leg portions that is closer to the drinking aperture plug than a bend point for the connection leg portion. Adjustment of the hinge and pivot arrangement can provide for increased amount of preload biasing the drinking aperture plug towards the lid body as well as the amount of force and travel required to transition the drinking aperture plug away from the lid body.

In one embodiment, the engagement between the drinking aperture plug and the lid body in the second closed position is sufficiently strong to prevent disengagement therebetween by biasing the lever tab towards the annular sidewall a corresponding amount that would transition the snap closure from the first closed position to the open position. Alternatively, the engagement between the drinking aperture plug and the lid body in the second closed position is sufficiently strong to prevent disengagement therebetween by biasing of the lever tab towards the annular sidewall. These arrangements provide a sufficient level of restriction to prevent easily transitioning the drinking aperture plug away from the drinking aperture to avoid spilling during travel or movement of the container.

In a further implementation, a container lid is provided incorporating those features focused on the lid discussed above.

In yet another embodiment, a container is provided comprising a container body and lid. The container body has an annular sidewall extending from a closed bottom. The annular sidewall and closed bottom define a cavity for storing a liquid. The annular sidewall has an open end opposite the closed bottom. The lid is releasably attached to the open end of the container body. The lid includes a lid body extending across the open end of the container body and substantially closing the open end. The lid body includes a drinking aperture passing therethrough permitting access into the cavity through the lid body. The lid also includes a snap closure attached to the lid body pivoting relative thereto. The snap closure including a drinking aperture closure aligned with the drinking aperture. The snap closure is pivotable relative to the lid body between an open position with the drinking aperture closure portion spaced away from the lid body to permit fluid flow through the drinking aperture, a first closed position wherein the drinking aperture closure portion is axially biased against an outer surface of the lid body and sealing the drinking aperture, and a second closed position wherein the snap closure is secondarily engaged with the lid body to prevent the drinking aperture closure portion from being pivoted away from the drinking aperture.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
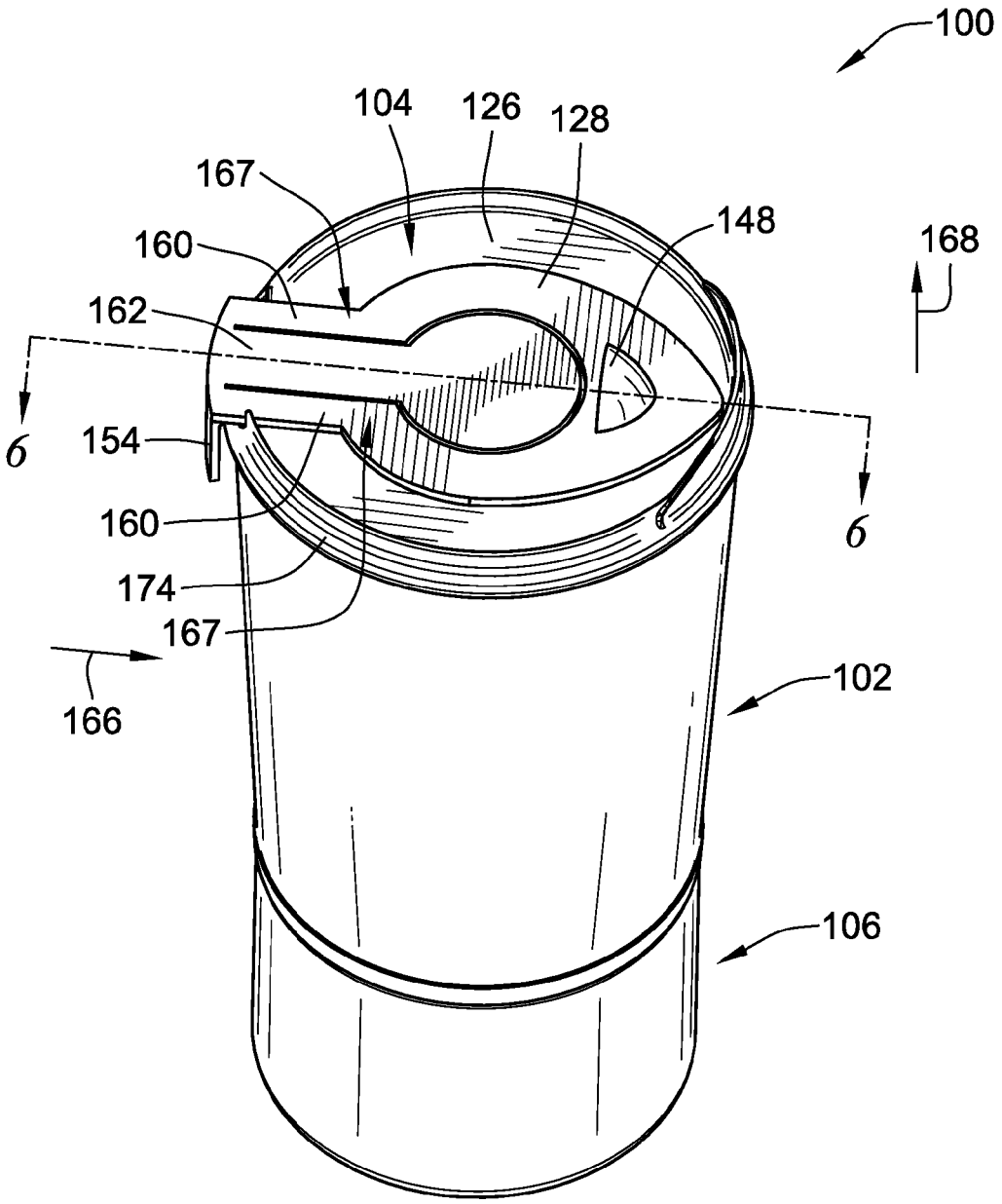
FIG. 1 is a top perspective illustration of a cup according to the present invention.

FIG. 1 is a perspective illustration of a drinking cup 100 (also referred to as "cup 100") according to an embodiment of the present invention. The cup 100 is more preferably in the form of a thermally insulated mug that does not include a handle for holding the mug. However, various ones of the features and benefits of the present invention can be incorporated into numerous vessels or containers for holding drinks The cup 100 finds particular applicability for holding fluids such as coffee or tea. The cup 100 generally includes a cup body 102, a lid 104 and a storage compartment 106. The lid 104 releasably attaches to an open end of the cup body 102 to generally form an enclosed cavity for storing the fluids, such as when the user is not drinking from the cup 100. The storage compartment 106 attaches to a closed end of the cup body 102, opposite the end to which the lid 104 is attached. The storage compartment, in one embodiment, snap attaches to the cup body 102 and is used to store product such as dry coffee or tea that can be added to a liquid, such as water, within the cup body 102 to make the tea or coffee. Alternatively, sugar or creamer, or similar product, could be stored in the storage compartment for later use. Other embodiments, might utilize a threaded connection between the cup body 102 and the storage compartment 106.

Figure 2:
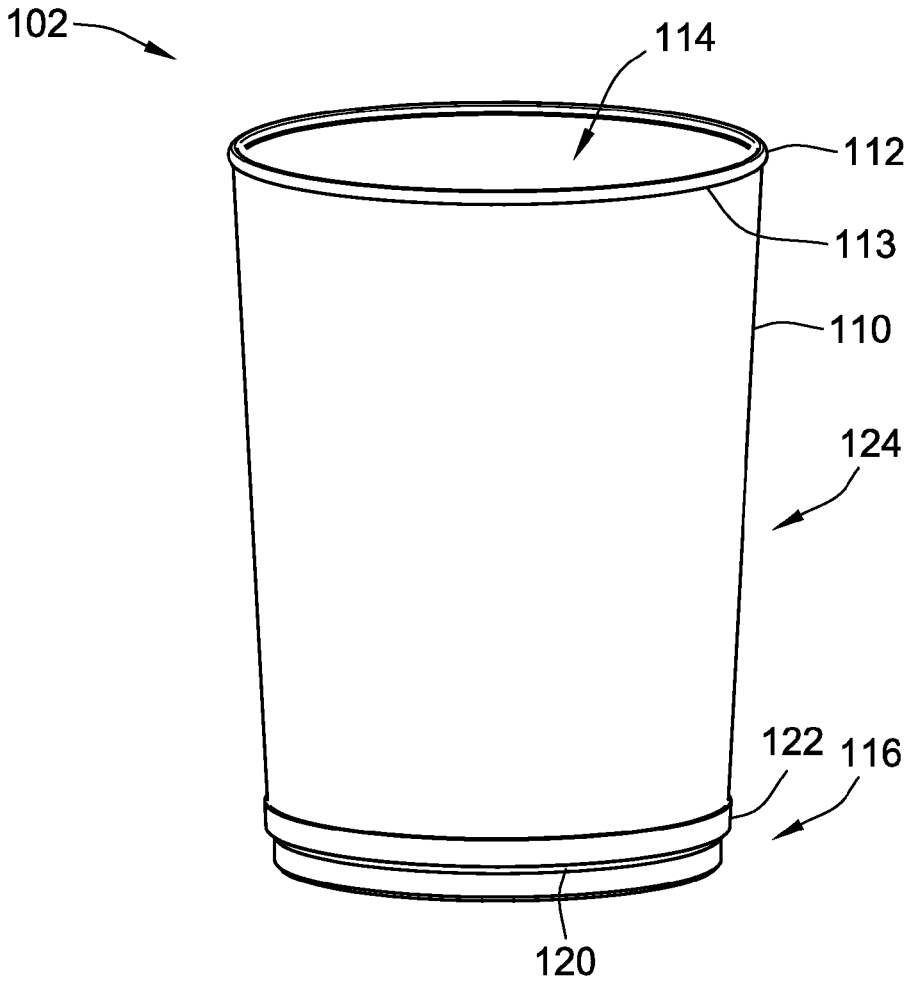
FIG. 2 is a top perspective illustration of a container body of the cup of FIG. 1.

With reference to FIG. 2, the cup body 102 generally includes an annular sidewall 110 that has an open free end 112. The open free end 112 leads to cavity 114 in which the liquid is stored. The annular sidewall 110 extends radially outward at the open free end 112 to form an undercut 113 or catch arrangement for engagement with a cooperating structure of lid 104 such that the lid 104 can be attached to the cup body y to substantially close the open free end 112 when liquid is stored within cavity 114.

Opposite free end 112 is a closed end 116 that forms a bottom of the cup body 102. The closed end 116 includes an undercut 120 for attachment of the storage compartment 106. The annular sidewall 110 also includes a radially outward extending portion 122 proximate the bottom of the cup body 102. As such, a recess 124 is generally formed axially between undercut 113 and radially extending portion 122. A shell, typically metal, may be attached to a the cup body 102 between these two structures so as to provide an improved feel and look to the cup 100. In such an arrangement, the cup body 102 is typically a plastic material to reduce cost and provide additional thermal insulation. The recess 124 will, most typically, be about the same thickness as the metal shell or similarly arranged such that the metal shell is generally smooth with regard to free end 112 and closed end 116. However, the flared out portion of free end 112 may extend radially outward past the outer surface of the shell so as to facilitate attachment of lid 104 to cup body 102.

Figure 3:
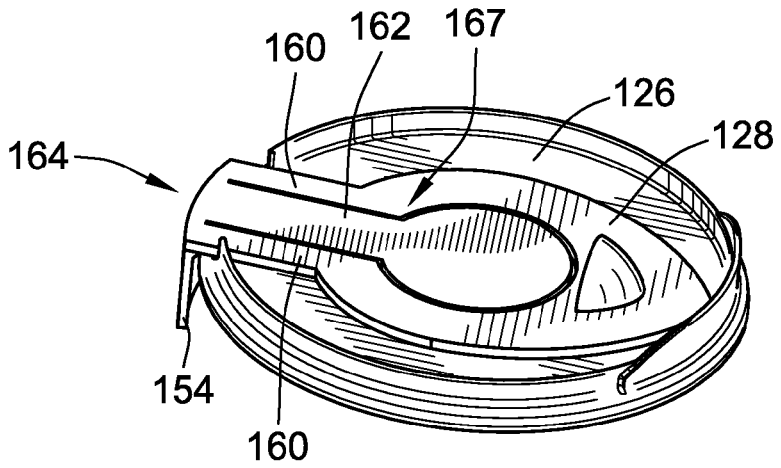
FIG. 3 is a top perspective illustration of the lid of the cup of FIG. 1.

Returning to FIG. 1 and with further reference to FIG. 3, the lid 104 of the illustrated embodiment is a two piece assembly that includes a lid body 126 to which a snap closure 128 is attached. The lid 104 operates to close the cup body 102 while selectively permitting access to the cavity 114 of cup body 102 to permit a user to drink the contents of cup 100.

Figure 4:
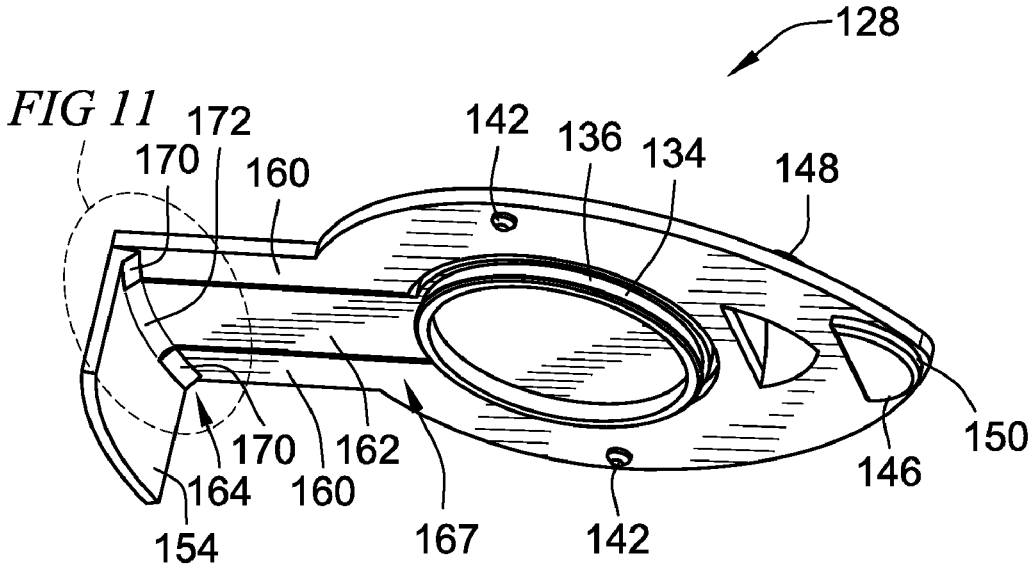
FIG. 4 is a bottom perspective illustration of the snap closure of the lid of FIG. 3.
Figure 5:
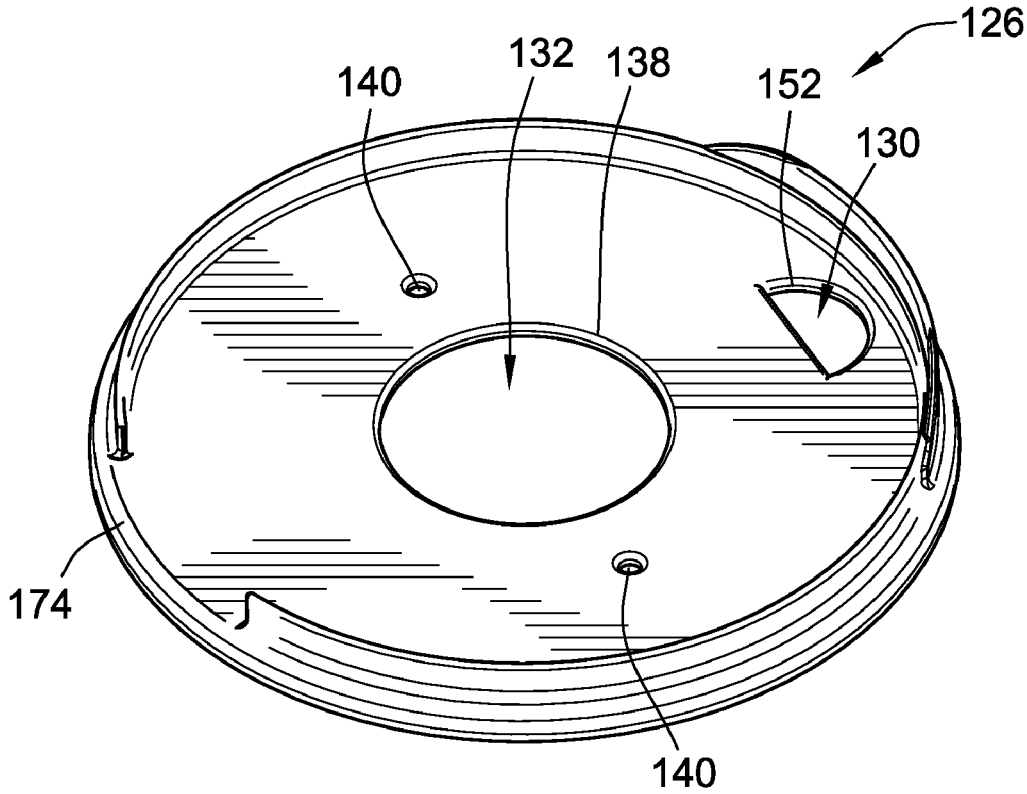
FIG. 5 is a top perspective illustration of the lid body of the lid of FIG. 3.

With additional reference to FIGS. 3-5, the lid body 126 includes a drinking aperture 130 through which liquid can exit the cavity of the cup 100. The snap closure 128 can be selectively pivoted relative to the lid body 126 between various positions so as to selectively open and close the drinking aperture 130.

The lid body 126 further includes a connection aperture 132 in which a connection hub 134 of the snap closure 128 is snap engaged to connect the snap closure 128 to the lid body 126. The connection hub 134 and lid body 126 preferably form a sealing engagement to prevent leakage therebetween. The connection hub 134 includes a catch formed by a radially recessed groove 136 in which the inner edge 138 of the lid body 126 is received to create an axial interference fit between the connection hub 134 and lid body 126 to create the engagement and seal therebetween.

A pair of vent holes 140 in the lid body 126 interact with a pair of vent plugs 142 on an underside of the snap closure 128 to permit venting of air when the snap closure 128 is in an open condition permitting fluid flow through drinking aperture 130. However, in a closed condition of the snap closure 128, the vent plugs 142 prevent fluid flow through the vent holes 140 to prevent undesired leakage. The vent holes 140 and vent plugs 142 have cooperating contours to promote locating of the vent plugs 142 in the vent holes 140 and to facilitate an improved seal therebetween.

The snap closure 128 further includes a drinking aperture closure portion illustrated in the form of a drinking aperture plug 146 that acts to seal drinking aperture 130. The drinking aperture plug 146 has an outer periphery that has a corresponding shape to the drinking aperture 130. In one embodiment, the drinking aperture plug 146 has an outer periphery that is slightly larger than the drinking aperture 130 such that it can seal the drinking aperture 130 in two ways.

The snap closure 128 can provide a tight strong seal (see e.g. FIG. 7) that is difficult to open for situations when the user is not intending on drinking from the cup such as during standard transportation and a second closure that is not difficult to open for situations where the user is intending on repeatedly opening and closing the drinking aperture 130 in a short period of time.

Figure 6:
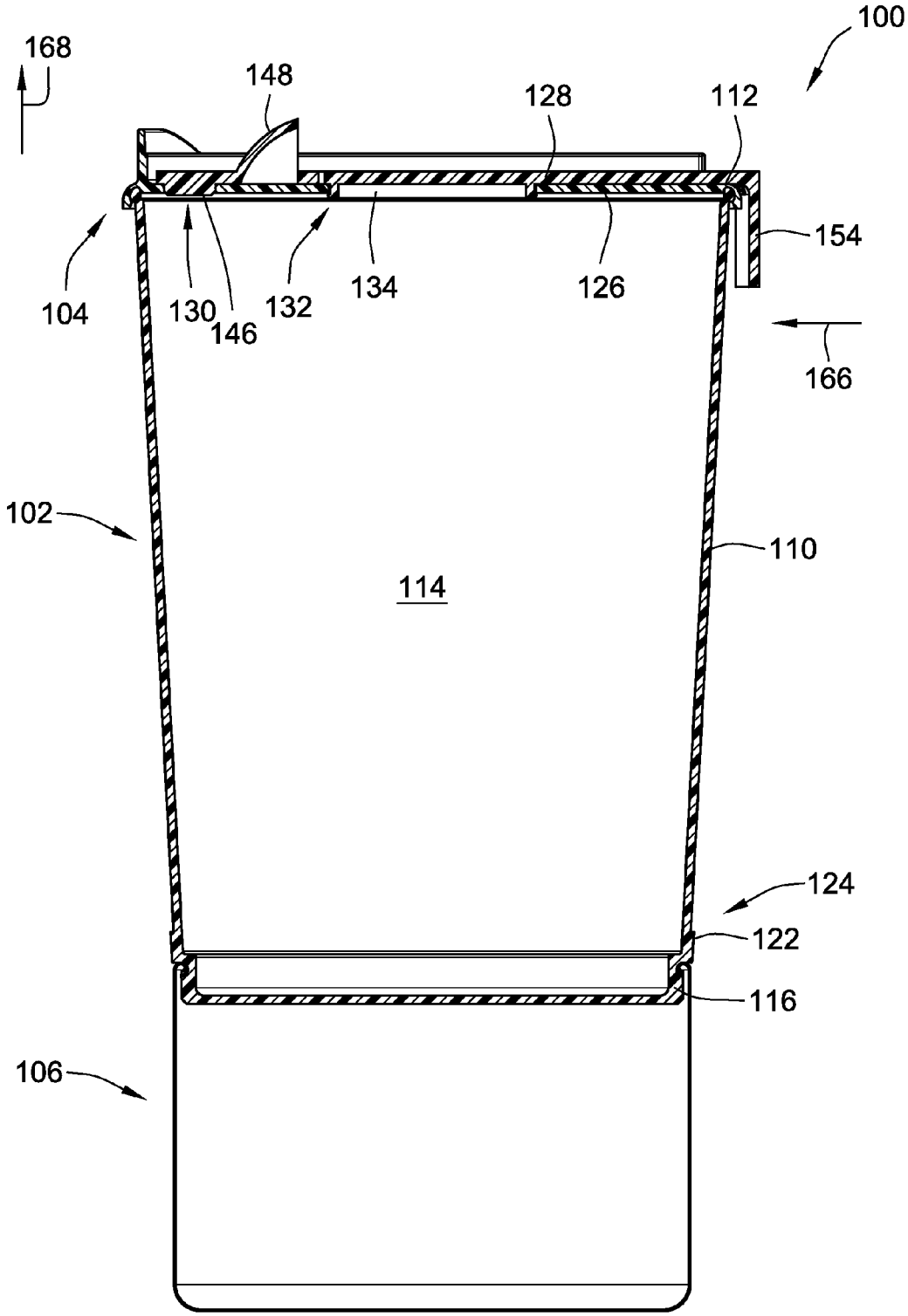
FIG. 6 is a cross-sectional illustration of the cup of FIG. 1 taken about line 6-6.

In a first way, (illustrated in FIGS. 6 and 7), the drinking aperture plug 146 is press fit into the drinking aperture 130 to create a high level of engagement therebetween. This high level of engagement is sufficient that the snap closure 128 includes a handle 148 on an outer side thereof for engagement by a user's finger to permit disengagement of the drinking aperture plug 146 from the drinking aperture 130.

Preferably, but not in all embodiments, in this high level of engagement position, an interference fit occurs between the two parts. In one particular implementation, the drinking aperture plug 146 is formed from a lower density material relative to the lid body 126 such that the drinking aperture plug 146 will deform radially inward when inserted into the drinking aperture 130. After press-fit insertion, portions the outer periphery of the drinking aperture plug 146 that were previously radially inwardly deformed that are axially below the lid body 126 expand radially outward and overlap with the lid body 126 to form the interference fit.

In alternative embodiments, the drinking aperture plug 146 and drinking aperture 130 could have cooperating catch arrangements, for example like the connection hub 134 and connection aperture 132. This arrangement is most likely used during movement of the cup 100 when limited or no drinking will occur and there may be larger forces applied to the cup 100 that could result in accidental leakage by altering the location of the drinking aperture plug 146 relative to the drinking aperture 130.

Further yet, in other embodiments, as noted previously, an interference fit is not needed but merely a friction fit is provided to secure drinking aperture plug 146 within drinking aperture 130.

Figure 9:
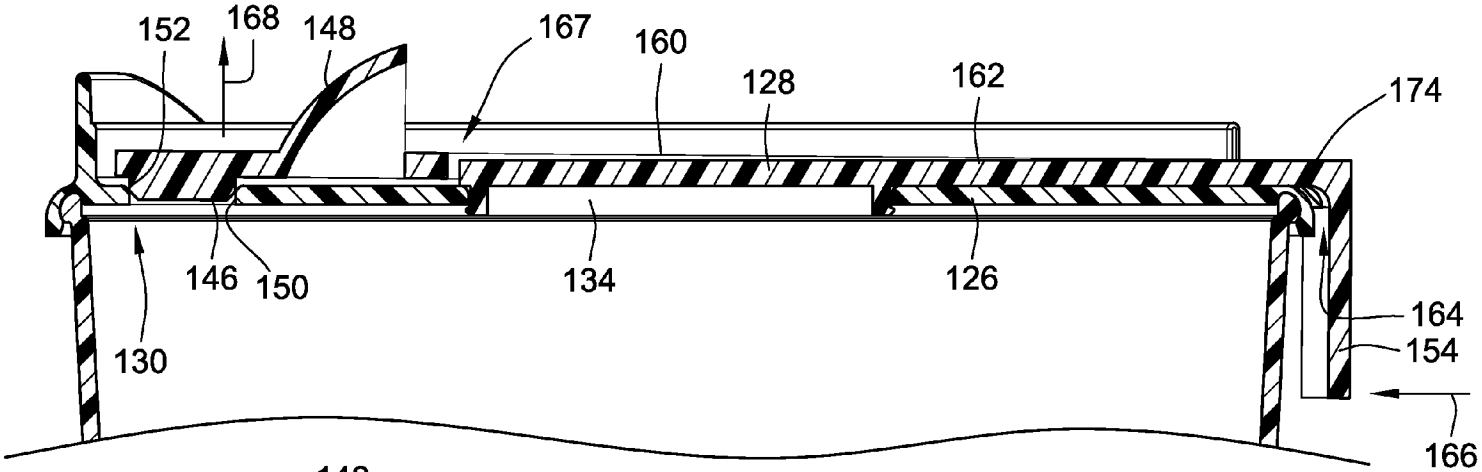
FIG. 9 is further cross-sectional illustration illustrating the snap closure in a second closed position.

In a second way of sealing, (see FIG. 9) the drinking aperture plug 146 is merely biased against the lid body 126, but is not engaged therewith. More particularly, a continuous biasing force is required to maintain the drinking aperture plug 146 pressed against the lid body 126. As used herein engaged requires more than mere abutting contact and thus two things that are merely held against one another by external forces are not engaged. This is the typical arrangement when a user is desiring to selectively and repeatedly drink from the cup 100.

In this arrangement, outer chamfer 150 of the drinking aperture plug 146 will be axially biased against inner chamfer 152 bounding drinking aperture 130. This arrangement provides some seal of drinking aperture 130, but to a lesser degree than when the drinking aperture plug 146 is engaged into drinking aperture 130. In this second arrangement, the drinking aperture plug 146 acts more like a cover, rather than a plug.

Figure 7:
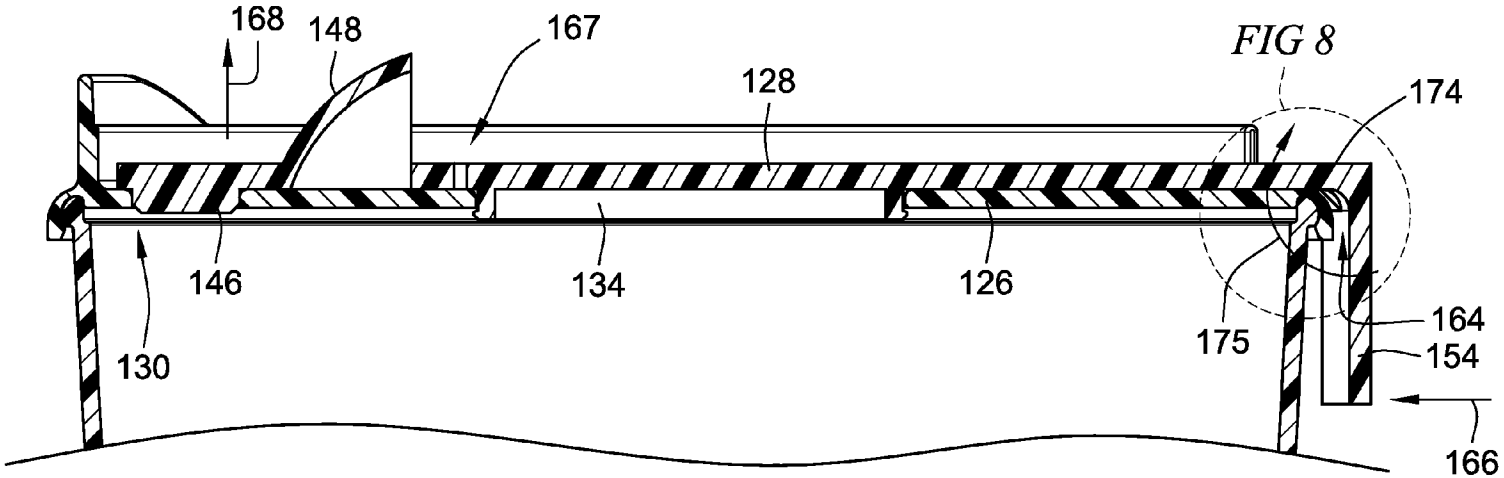
FIG. 7 is an enlarged partial illustration of the cross-sectional illustration of FIG. 6.

With reference to FIGS. 1 and 7, while the snap closure 128 is snap connected to the lid body 126, portions of the snap closure 128 can pivot relative thereto. The snap closure 128 includes a lever tab 154 that a user can press towards the cup body 102 to transition the drinking aperture plug 146 away from the drinking aperture 130. As illustrated in FIG. 1, the lever tab 154 extends axially along the sidewall 110.

The snap closure 128 includes a pair of outer leg portions 160 that form lifting leg portions that straddle a single inner leg portion 162 that is a connection leg portion. A hinge and pivot arrangement 164 is interposed between the lever tab 154 and leg portions 160, 162. A U-shaped gap 167 generally separates the outer leg portions 160 from inner leg portion 162 such that the outer leg portions 160 can pivot relative to inner leg portion 162.

The outer leg portions 160 are mechanically interposed between the lever tab 154 and the drinking aperture plug 146. The outer leg portions 160 transfer loading applied to the lever tab 154 by a user in a direction extending toward cup body 102 (see arrow 166) to the drinking aperture plug 146 such that the drinking aperture plug 146 is biased in a direction extending away from the top surface of the lid body 128 (see arrow 168).

The inner leg portion 162 is mechanically interposed between the lever tab 154 and the connection hub. This arrangement keeps the snap closure 128 connected to the lid body 126 when load, illustrated by arrow 166, is applied to the lever tab 154 by a user to open the lid (see FIG. 10) to allow the user to drink from the cup 100.

The hinge and pivot arrangement 164 provides a camming arrangement that permits the loading, illustrated by arrow 166, applied to lever tab 154 by a user to lift the drinking aperture plug 146 away from the drinking aperture 130, such as illustrated by arrow 168.

Figure 8:
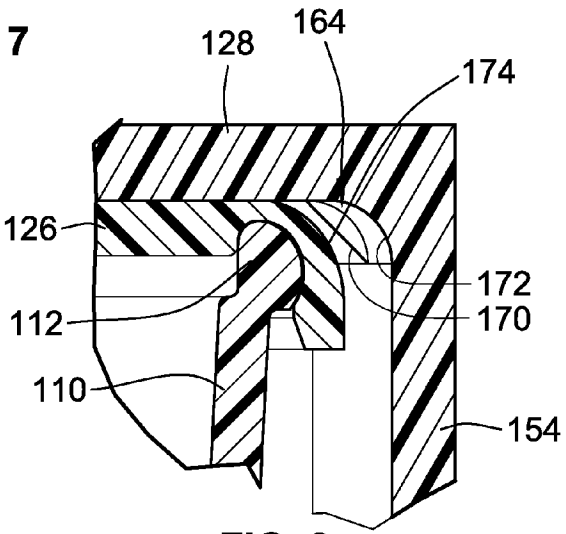
FIG. 8 is a further enlarged partial illustration of the cross-sectional illustration of FIG. 6 illustrating the hinge and pivot arrangement of the lid and snap closure.

With primary reference to FIGS. 4 and 8, because the snap closure 128 is a continuous, one-piece construction (i.e. it is formed from a single continuous piece of material, such as molding, and not separate pieces of material held together by welds, snap engagements, screws, etc.) the hinge and pivot arrangement 164 generally provides a living hinge between the outer leg portions 160 and inner leg portion 162.

Further, the pivot and hinge arrangement 164 provides three pivot segments including two outer cams 170 and one inner pivot point 172. One outer cams 170 is associated with each of the outer legs 160. The outer cams 170 are interposed between and generally provide the transition from the lever tab 154 into outer legs 160. The inner pivot point 172 is associated with the inner leg 162 and is interposed and generally provides the transition from the lever tab 154 into inner leg 162.

Pivot segments 170, 172 have inner surfaces that face towards lid body 126. The inner surface of the outer cams 170 form chamfers and the inner surface of the pivot point 172 is a concave round. Lid body 126 includes an outer rim 174 that interacts with the chamfers of the outer cams 170. The rim 174 acts as a fulcrum to permit pivoting of the two outer legs 160 relative to inner leg 162 and the rest of lid body 126 so as to raise the drinking aperture plug 146 away from lid body 126 when a user applies loading to lever tab 154.

Figure 10:
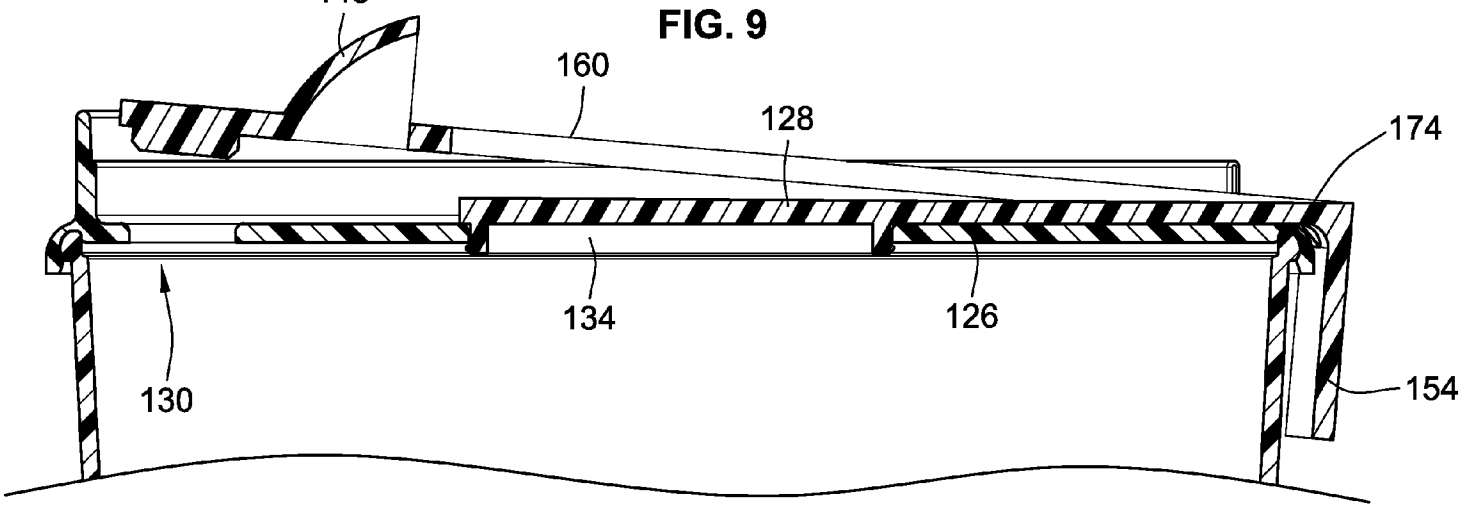
FIG. 10 is further cross-sectional illustration illustrating the snap closure in an open position.
Figure 11:
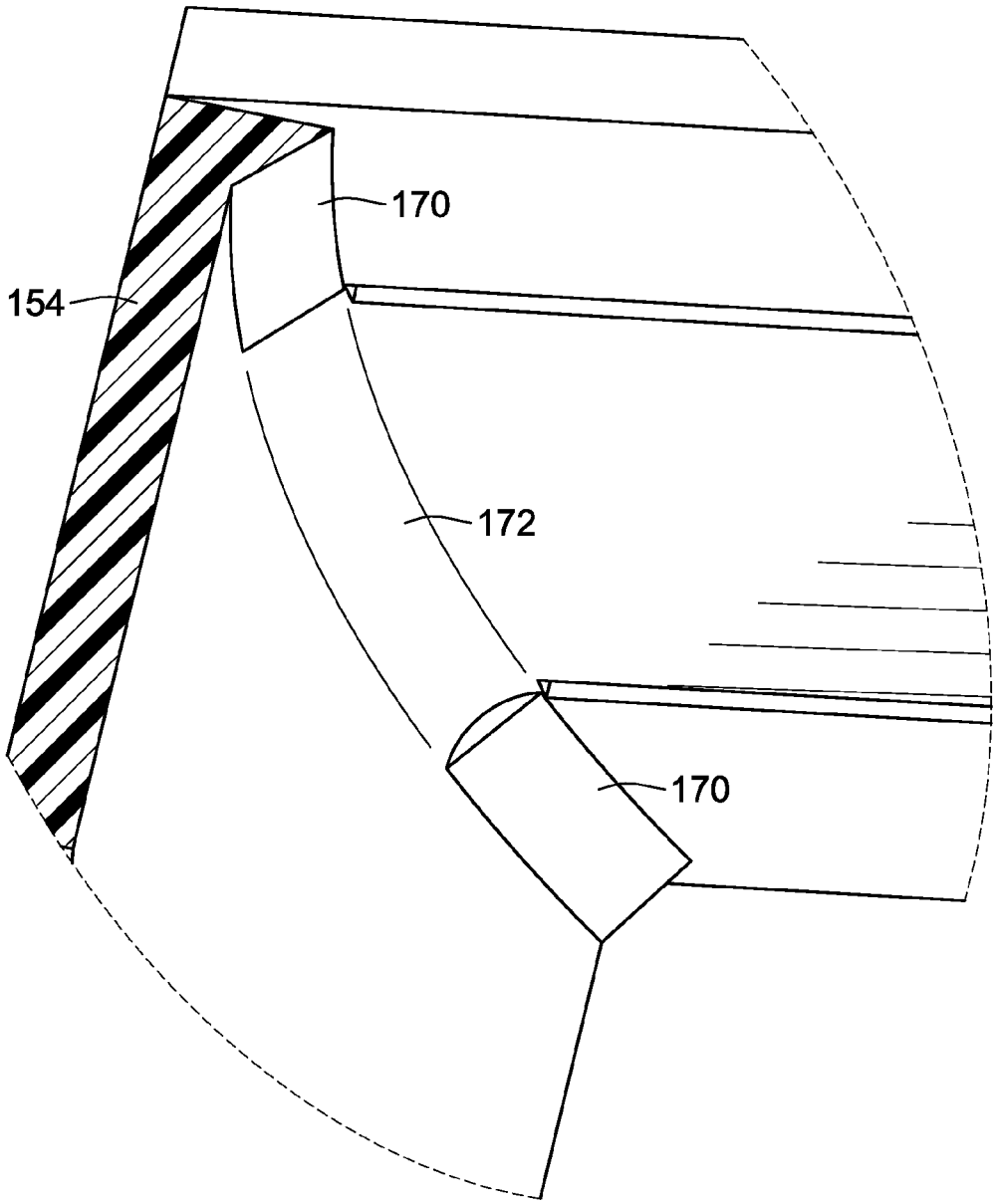
FIG. 11 is an enlarged partial illustration of the hinge region of the snap closure.
Figure 12:
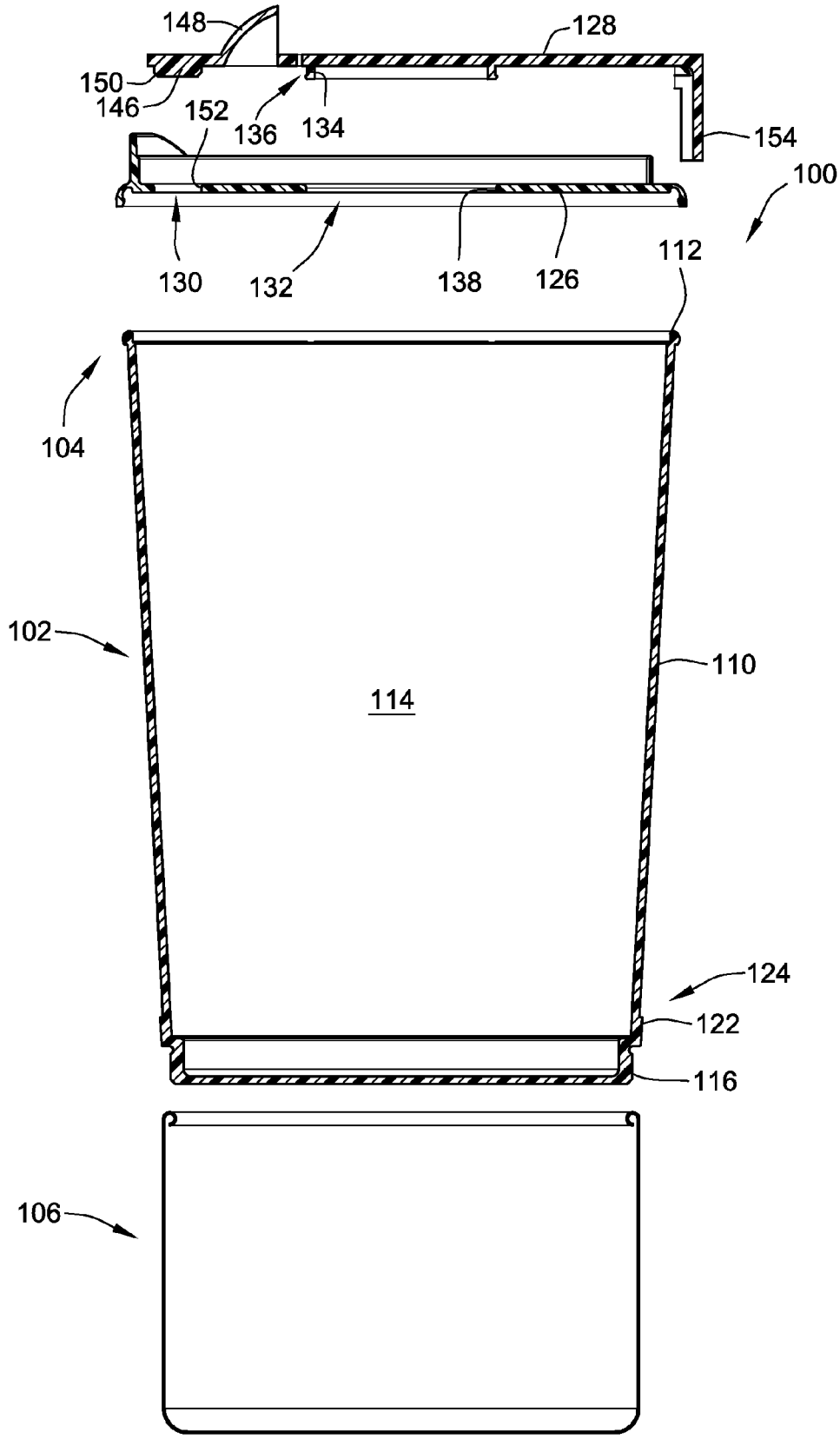
FIG. 12 is an exploded cross-sectional illustration of the container of FIG. 1.

When the user presses lever tab 154 towards the cup body 102, the snap closure 128 pivots about the interaction between cams 170 and rim 174 causing portions of the snap closure 128 to tend to pivot (illustrated as arrow 175) such that the drinking aperture plug 146 wants to move axially away from lid body 126 (illustrated as arrow 168) to the open orientation illustrated in FIG. 10.

However, because inner leg 162 is attached to lid body 126 via connection hub 134, this portion of the snap closure 128 remains connected to the lid body 126 and only outer legs 160 pivot to transition the drinking aperture plug 146 away from lid body 126. Notably, inner leg 162 may bow vertically upward, but in general, remains fixed relative to lid body 126.

In the preferred embodiment, the outer cams 170 are radially inward of the pivot point such that they contact the rim 174 while the pivot point 172 does not. When a load is applied to lever tab 154, the inner leg 162 will bend at pivot point 172 while the outer legs 160 will apply a force at the ends of the chamfer of the outer cams 170. This generates different bend points causing the outer legs 160 to raise up as the inner leg 162 bends around pivot point 172. However, this is not required in all arrangements.

Because the drinking aperture plug 146 extends from an inner surface of snap closure 128, the snap closure is in a state of pre-load when in the second seal arrangement, i.e. when the drinking aperture plug 146 is not engaged in the drinking aperture 130. Further assisting in pre-loading the drinking aperture plug 146 against the outer surface of the lid body 126 is the fact that cams 170 may also raise the lever tab end of the snap closure 128 away from the lid body 126 as well. However, the connection hub 134 tends to pull the snap closure 128 toward the lid body 126 generating a torque biasing the drinking aperture plug 146 towards the lid body 126. This torque is transferred from inner leg 162 to the outer legs 160 through the pivot and hinge arrangement 164. In this seal arrangement, sufficient force can be applied through the lever tab 154, such as illustrated by arrow 166, and the pivot and hinge arrangement 164 to bias the outer legs 160 away from the lid body 126 so as to open the drinking aperture 130.

This allows the user to selectively and repeatedly open and close the drinking aperture 130 as desired by pressing lever tab 154.

It is preferred in the first seal arrangement (illustrated in FIG. 7) that the spring force generated by pressing the lever tab 154 radially inward toward the cup body 102 is insufficient to break the engagement between the drinking aperture plug 146 and the drinking aperture (i.e. the portion of the lid body 126 forming/bounding the drinking aperture 130). This provides the two different levels of sealing or restriction on the flow of fluid through drinking aperture 130. Thus, this is why handle 148 is added to the snap closure 128 so as to assist disengagement of the drinking aperture plug 128 from the drinking aperture 130 when in the first sealing arrangement.

While a particular hinge and pivot arrangement 164 is illustrated, other arrangements are contemplated. For instance, the three segments could be replaced by a continuous chamfer extending across the width of the outer leg portions 160 and inner leg portion 162. Variations in the materials, shape and position of the hinge and pivot arrangement can assist in varying the amount of force and power generated to lift the drinking aperture plug 146 away from the lid body 126 over a given degree of translation of lever tab 154 toward cup body 102. Variations such as changes in shape, location and thickness of the structure of the hinge and pivot arrangement 164 can vary the pivot points for the various leg portions 160, 162 to be either closer or further from the central point of the lid body 126 which adjust the travel of the drinking aperture plug 146 away from the lid body 126 and consequently the amount of force required to move the drinking aperture plug 146.

Additionally, further embodiments of the invention need not include an actual plug that extends from the rest of the snap closure portion. Instead, a flat portion that is biased against the outer surface of the lid body 126 would suffice. However, to provide the multiple levels of restriction to pivoting due to movement of lever tab 154 alternative structure could engage the lid body 126, but at a different location than drinking aperture 130. For instance, the vent plugs 142 could snap engage with vent holes 140 to provide the differing levels of resistance to opening of the drinking aperture 130.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A container comprising:

a container body having an annular sidewall extending from a closed bottom, the annular sidewall and closed bottom defining a cavity for storing a liquid, the annular sidewall having an open end opposite the closed bottom;

a lid releasably attached to the open end of the container body, the lid including:

a lid body extending across the open end of the container body and substantially closing the open end, the lid body including a drinking aperture passing therethrough permitting access into the cavity through the lid body;

a snap closure attached to the lid body and pivoting relative thereto, the snap closure including a drinking aperture plug aligned with the drinking aperture; and the snap closure pivotable relative to the lid body between an open position with the drinking aperture plug spaced away from the lid body to permit fluid flow through the drinking aperture, a first closed position wherein the drinking aperture plug is axially biased against an outer surface of the lid body and closing the drinking aperture and a second closed position wherein the drinking aperture plug is engaged within the drinking aperture; and wherein the snap closure further includes a lever tab extending substantially perpendicular to the open end of the container body, and a connection leg portion and a lifting leg portion extending substantially perpendicular to the lever tab, the connection leg portion operably attached to lid body and the lifting leg portion operably substantially rigidly mechanically connecting the lever tab to the drinking aperture plug, the lever tab being radially spaced outward from the annular sidewall such that biasing of the lever tab towards the annular sidewall biases the drinking aperture plug axially away from the lid body to open the drinking aperture.

2. The container of claim 1, wherein the snap closure includes a hinge and pivot arrangement interposed between the lever tab and the connection leg and lifting portions, the hinge and pivot arrangement including at least one cam surface resting against a fulcrum portion of the lid body, the hinge and pivot arrangement pivoting about the fulcrum portion to bias the drinking aperture plug away from the drinking aperture when the lever tab is biased towards the annular sidewall.

3. The container of claim 2, wherein the snap closure includes a first and second lifting leg portions, the connection leg portion being laterally interposed between and laterally spaced from the first and second lifting leg portions.

4. The container of claim 3, wherein the hinge and pivot arrangement includes a first chamfered region connecting the first lifting leg portion to the lever tab, a second chamfered region connecting the second lifting leg portion to the lever tab and a concave round region connecting the connection leg portion to the lever tab, the first and second chamfered regions straddling the concave round region, the first and second chamfered regions and concave round region acting to provide a bend point for the first and second lifting leg portions that is closer to the drinking aperture plug than a bend point for the connection leg portion.

5. The container of claim 4, wherein engagement between the drinking aperture plug and the lid body in the second closed position is sufficiently strong to prevent disengagement therebetween by biasing the lever tab towards the annular sidewall a corresponding amount that would transition the snap closure from the first closed position to the open position.

6. The container of claim 4, wherein the engagement between the drinking aperture plug and the lid body in the second closed position is sufficiently strong to prevent disengagement therebetween by biasing of the lever tab towards the annular sidewall.

7. The container of claim 1, wherein the force axially biasing the drinking aperture plug against the lid body is provided by spring force due to bending within the snap closure.

8. The container of claim 7, wherein the snap closure is a continuous one-piece construction.

9. A container lid comprising:

a lid body including attachment structure to attach the lid to a corresponding cup, the lid body including a drinking aperture passing therethrough; and a snap closure attached to the lid body and pivoting relative thereto, the snap closure including a drinking aperture plug aligned with the drinking aperture; and the snap closure pivotable relative to the lid body between an open position with the drinking aperture plug spaced away from the lid body to permit fluid flow through the drinking aperture, a first closed position wherein the drinking aperture plug is axially biased against an outer surface of the lid body but not engaged therewith and closing the drinking aperture and a second closed position wherein the drinking aperture plug is engaged within the drinking aperture; and wherein the snap closure further includes a lever tab extending substantially perpendicular to the lid body, and a connection leg portion and a lifting leg portion extending substantially perpendicular to the lever tab and parallel to the lid body, the connection leg operably attached to lid body and the lifting leg operably substantially rigidly mechanically connecting the lever tab to the drinking aperture plug, the lever tab being radially spaced outward from an outer peripheral rim of the lid body and biasing of the lever tab radially inward toward the lid body is translated into axial biasing of the drinking aperture plug away from the lid body to open the drinking aperture.

10. The container lid of claim 9, wherein the snap closure includes a hinge and pivot arrangement interposed between the lever tab and the connection leg portion and lifting leg portion, the hinge and pivot arrangement including at least one cam surface resting against a fulcrum portion of the lid body provided by the outer peripheral rim, the hinge and pivot arrangement pivoting about the fulcrum portion to bias the drinking aperture plug away from the drinking aperture when the lever tab is biased radially inward.

11. The container lid of claim 10, wherein the snap closure includes a first and second lifting leg portions, the connection leg portion being interposed between and laterally spaced from the first and second lifting leg portions.

12. The container lid of claim 11, wherein the hinge and pivot arrangement includes a first chamfer connecting the first lifting leg portion to the lever tab, a second chamfer connecting the second lifting leg portion to the lever tab and a concave round connecting the connection leg portion to the lever tab, the first and second chamfers laterally straddling the concave round, the first and second chamfers and concave round acting to provide a bend point for the first and second lifting leg portions that is closer to the drinking aperture plug than a bend point for the connection leg portion.

13. The container lid of claim 12, wherein engagement between the drinking aperture plug and the lid body in the second closed position is sufficiently strong to prevent disengagement therebetween by biasing the lever tab radially inward a corresponding amount that would transition the snap closure from the first closed position to the open position.

14. The container lid of claim 12, wherein the engagement between the drinking aperture plug and the lid body in the second closed position is sufficiently strong to prevent disengagement therebetween by biasing of the lever tab towards the annular sidewall.

15. The container lid of claim 9, wherein the force axially biasing the drinking aperture plug against the lid body is provided by spring force due to bending within the snap closure.

16. The container lid of claim 15, wherein the snap closure is a continuous one-piece construction.

* * * * *